US006745416B2

(12) United States Patent
Albarrán

(10) Patent No.: US 6,745,416 B2
(45) Date of Patent: Jun. 8, 2004

(54) DESIGN TO FIX SINKS

(75) Inventor: José Gómez Albarrán, Maliano (ES)

(73) Assignee: Teka Industrial S.A., Santander (ES)

( * ) Notice: Subject to any disclaimer, the term of this patent is extended or adjusted under 35 U.S.C. 154(b) by 0 days.

(21) Appl. No.: 10/340,076

(22) Filed: Jan. 10, 2003

(65) Prior Publication Data

US 2004/0078892 A1 Apr. 29, 2004

(30) Foreign Application Priority Data

Oct. 23, 2002 (ES) ..... 200202553

(51) Int. Cl.[7] ..... E03C 1/33
(52) U.S. Cl. ..... 4/633
(58) Field of Search ..... 4/631–634, 619, 4/649, 635, 636; 24/456, 457, 514; 403/387

(56) References Cited

U.S. PATENT DOCUMENTS

| | | | | | |
|---|---|---|---|---|---|
| 2,925,609 | A | * | 2/1960 | Richardson | 4/633 |
| 3,020,563 | A | * | 2/1962 | Just | 4/633 |
| 3,034,144 | A | * | 5/1962 | Lyon | 4/634 |
| 3,613,128 | A | * | 10/1971 | Moyer | 4/650 |
| 4,589,170 | A | * | 5/1986 | Ponting | 24/456 |

* cited by examiner

*Primary Examiner*—Gregory L. Huson
*Assistant Examiner*—Huyen Le
(74) *Attorney, Agent, or Firm*—Collen IP; Donald J. Ranft

(57) ABSTRACT

An improved means to position and secure a sink which is flush mounted with the worktop. It is designed to be used with sinks of variable thickness and materials including stainless steel.

8 Claims, 1 Drawing Sheet

DESIGN TO FIX SINKS

AIM OF THE INVENTION

This descriptive report deals with a request for a Utility Model concerning an improved design for the fitting of sinks, the end of which lies in designing a medium capable of holding sinks, specifically, stainless steel sinks to be fitted flush with the worktop.

SCOPE OF THE INVENTION

This invention is be used in the industrial sector that deals in the manufacturing of stainless steel sinks and similar.

HISTORY OF THE INVENTION

As is well know, sinks that are to be flush-fitted aim at achieving a complete integration of the sink in question with the worktop, given that the surfaces of both the sink and the worktop are at the same level.

The applicant is familiar with some current media and designs for the fixing of flush-fitting sinks by the means of silicone and adhesive products that are applied at the bottom part of the perimeter of the sink, specifically at the bottom part of frame, which gives rise to the sink become housed in the staggering that is cut into the worktop surface.

There is evidence to suggest that the aforementioned media, which have been used to date, have certain disadvantages that may give rise to the moving of the sink itself, thus suggesting the convenience of using an additional element to solidly hold and fix the sink to the worktop; one which acts from below.

Nevertheless, the applicant is not aware of the fact that there is an invention which exists, and which possesses characteristics ideally suited to those mentioned above.

DESCRIPTION OF THE INVENTION

The improved design for the fixing of the sinks put forward by the invention contains a series of advantages which facilitate the fixing of the sinks whenever they are to be flush-fitted, enabling them to be fitted to worktops of varying degrees of thickness.

More specifically, the improved design to fix the sinks, which are the object of the invention, consists in the fitting, to the bottom part of the sink frame, of a winged projection positioned parallel to the bottom area of the frame, to which an oblong positioned U-shaped clamp is connected, from which a projecting hook emerges to which a winged projection screw emerging in the opposite direction, and which is positioned on the bottom part of the worktop, is connected.

By means of the simple action of a screwdriver, the lower screw gradually rises, thus giving rise to a gradual movement which implies, on the one hand, that the element on the bottom part is increasingly fixed to the under surface of the worktop, while, on the other hand, on the top part the U-shaped winged projection pulls the sink downwards vertically until achieving optimal fixing.

DESCRIPTION OF THE DRAWINGS

As a compliment to this description, and with the aim in mind of facilitating a greater understanding of the characteristics of the invention, accompanying this descriptive report, and forming an integral part of the same, there is a sheet of drawings on which, for the purposes of illustration, though not purporting to be comprehensive, the following has been represented.

PREFERENTIAL REALIZATION OF THE INVENTION

Figure 1:
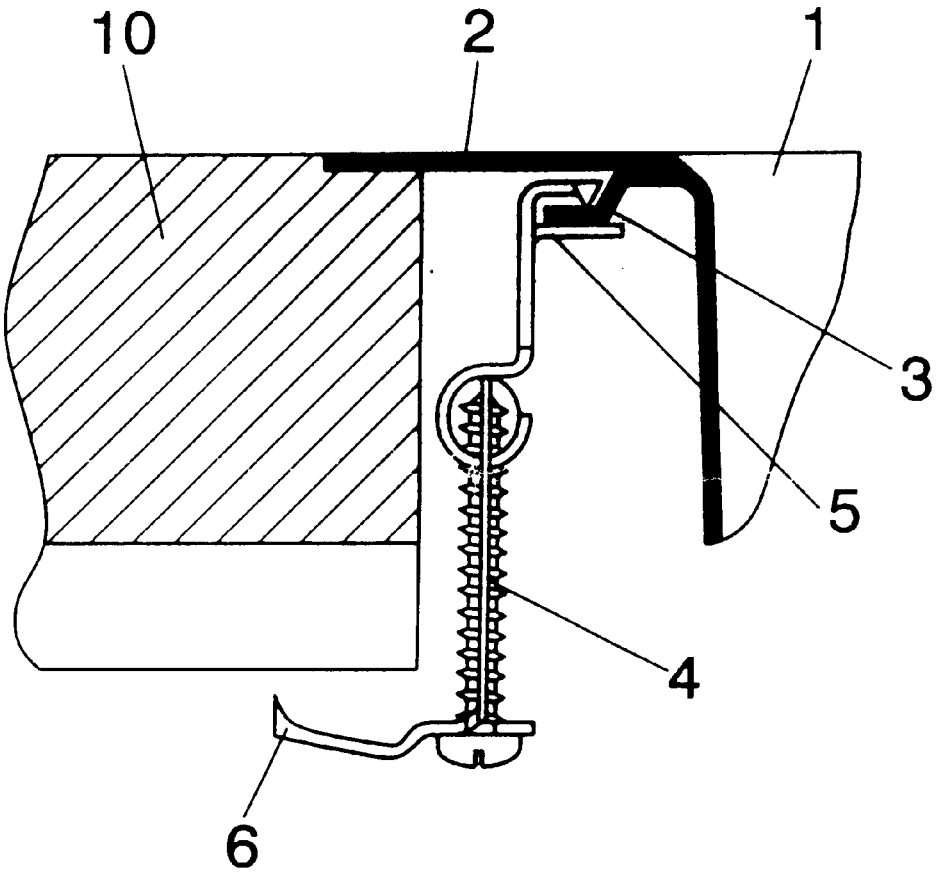
FIG. 1—This shows a raised side view of the object of the invention, which is concerned with an improved design for the fixing of sinks.

With the aid of sole FIG. 1, it can be seen how the improved design for the fixing of sinks is made up of the fitting to the side of the sink (1) parallel to the frame of the sink (2) of a winged projection (3), made from the same material and forming a single-blocked body with the frame (2) and the sink.

This winged projection (3) is positioned parallel to the frame (2) at its bottom part, and has an oblong part (5), which is U-shaped, connected to it, which implies that when this part is moved by means of the action of the lower screw (4) it is gradually pulled downwards vertically, while the screw acts by moving itself vertically downwards, and pulling at the same time a winged projection (6) which is gradually fixed to the underside of the workshop (10).

In this way, the duly flush-fitted sink, which, as can be seen from the figure is flush with the top surface of the worktop (10), is fixed at its bottom part by means of the action of the fixing element on the winged design (3), which is the part that gives rise to the shifting of the fixation element at the bottom.

I claim:

1. A means for fixing a sink flush with a worktop comprising:

a worktop with an opening for insertion of a sink;

the sink having an outer side wall;

the sink having a top flat surface extending beyond the outer side wall the sink around its entire circumference;

the worktop having a flat recession extending back from back from edge of opening for the sink;

the depth and width of the recession on top of the worktop extending away from the opening for the sink being sized to accept the extended flat top surface of the sink such that the top of the worktop and extended flat top surface of the sink are flush;

a winged projection affixed to the outer side wall of the sink;

one end of the winged projection being a flat surface below and parallel to the extended flat top surface of the sink;

a pull element with an oblong U-shaped clamp at its one end to encompass the winged projection affixed to the outer side wall of the sink and terminating at the opposite end in a partly open circle with a treaded hole;

a screw with a winged projection extending from its top and engaged into the threaded opening at the one end of the pull element;

the winged projection at the end of the screw rotatable to engaged bottom of the worktop so that rotation of the screw will pull the sink downward vertically.

2. A means for fixing a sink flush with a worktop according to claim 1 wherein the screw and pull element are sized according to the depth of the worktop.

3. A means for fixing a sink flush with a worktop according to claim 1 wherein the sink is stainless steel.

4. A means for fixing a sink flush with a worktop according to claim 1 wherein multiple pull elements are located around the outer wall of the sink.

5. A method for fixing a sink flush with worktop comprising:

creating an opening in the worktop for insertion of a sink;

creating a sink with a top flat surface extending beyond its outer side walls;

creating recession in top of the work top extending away from the opening for the sink and sized to accept the extended flat surface of the sink;

affixing a winged projection to the outer side wall of the sink;

placing a pull element with an oblong U-shaped clamp at one end over the winged projection affixed to the outer side wall of the sink;

engaging a treaded opening at the other end of the pull element with a screw and a rotable winged projection at its top;

locating the rotatable winged projection at the top of the screw so as to engage the bottom of the worktop;

screwing the screw into the bottom of the pull element to pull the sink downward vertically to fix the sink.

6. A method for fixing a sink flush with worktop according to claim 5, wherein the sink is stainless steel.

7. A method for fixing a sink flush with worktop, according to claim 5 wherein the screw and pull element are sized according to depth of worktop.

8. A method for fixing a sink flush with worktop, according to claim 5 wherein multiple pull elements are located around the outer wall of the sink.

* * * * *